US005815137A

United States Patent [19]

Weatherford et al.

[11] Patent Number: 5,815,137

[45] **Date of Patent: *Sep. 29, 1998**

[54] HIGH SPEED DISPLAY SYSTEM HAVING CURSOR MULTIPLEXING SCHEME

[75] Inventors: Jim Weatherford; Brad W. Hoffert, both of Mountain View; Robert Stano, Sunnyvale; Shawn Storm, Menlo Park; Andreas Bechtolshein, Mountain View, all of Calif.

[73] Assignee: Sun Microsystems, Inc., Mountain View, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 326,311

[22] Filed: Oct. 19, 1994

[51] Int. Cl.[6] ..... G09G 5/08

[52] U.S. Cl. ..... 345/145; 345/162; 345/199

[58] Field of Search ..... 345/153, 155, 345/157, 162, 145, 185, 186, 199, 510, 507; 395/164

[56] References Cited

U.S. PATENT DOCUMENTS

| | | | |
|---|---|---|---|
| 4,833,462 | 5/1989 | Gover et al. | 345/145 |
| 4,987,551 | 1/1991 | Garrett, Jr. | 345/162 |
| 5,043,713 | 8/1991 | Katsura et al. | 345/133 |
| 5,254,978 | 10/1993 | Beretta | 345/199 |
| 5,313,228 | 5/1994 | Freeman | 345/145 |
| 5,389,947 | 2/1995 | Wood et al. | 345/145 |
| 5,396,263 | 3/1995 | Seiler et al. | 345/199 |

*Primary Examiner*—Lun-Yi Lao

*Attorney, Agent, or Firm*—Blakely Sokoloff Taylor & Zafman

[57] ABSTRACT

An apparatus and method for processing display data in multi-pixel sections which also tracks and maps a cursor in single pixel increments is disclosed. A video buffer card receives display data and generates display control data for a multi-pixel section of display frame, and cursor display information including cursor enable information, cursor color selection information, cursor color and blending information, and X and Y cursor location information. Additionally, the current horizontal and vertical location of the multi-pixel section of the display data is tracked and used in combination with the cursor X and Y location information to calculate an offset that is used to replace certain portions of the display data with cursor color information. The video buffer card also supports a blending operation which provides a blend of the cursor foreground and background colors with the displayed image colors.

20 Claims, 9 Drawing Sheets

HIGH SPEED DISPLAY SYSTEM HAVING CURSOR MULTIPLEXING SCHEME

BACKGROUND OF THE INVENTION

This Application is related to U.S. Application entitled "Synchronous Serial Display Monitor Control and Communications Bus Interface" (Ser. No. 08/632,754, filed Apr. 16, 1996) assigned to the same assignee, Sun Microsystems, Inc. of Mountain View, Calif., which is a continuation of U.S. application (Ser. No. 08/326,664, filed Oct. 19, 1994), assigned to the same assignee, Sun Microsystems, Inc. of Mountain View, Calif.

1. Field of the Invention

The present invention relates generally to computer display systems, and more particularly, to an apparatus and method for the mapping of a cursor on a high speed computer display, while providing color blending of graphical elements.

2. Description of the Related Art

Computer systems generally store display data used to generate images on a display monitor in Video Random Access Memory (VRAM) banks. While other types of memory including SRAM provide faster access times, VRAM provides data storage for large screen, color images having over a million pixels at much lower cost. VRAM, however, provides only mediocre access time. To increase its updating performance, a display image must be processed in multiple-bit sections.

Computer systems which provide graphical user interfaces generally utilize an on-screen cursor to provide feedback information to the user who controls software programs with a mouse or other location control input device. Because the mouse is often used for drawing, text manipulation or other functions that require precise control, it is necessary to track and display the cursor in single pixel increments on the display screen. This allows the computer user to perform various functions on the computer screen in a highly precise manner and thus take advantage of the dense graphics that a high quality display system offers.

The processing and transmission of display data in multiple pixel sections as is done for high speed display controllers makes it difficult, however, to introduce the cursor data into the image with single pixel precision. This is because the method by which the cursor must be placed within the section of pixels being processed is dependent on where within the section of pixels the cursor is located.

Accordingly, there is a need in the technology for an apparatus and method of receiving and processing display information in multiple pixel sections while providing cursor information which is processed in single pixel increments, on the same display.

In addition, each computer system's microprocessor or microprocessors must perform the highly repetitive task of handling interrupts from the mouse or other location control input device and writing the cursor image to the display. The system's microprocessor also has to store the original display data in memory before writing cursor image and restore the original data when the cursor moves or changes shape. This action then increases the complexity of a graphics accelerator since transactions to the space occupied by the cursor are then redirected to the memory where the original display data was stored. Performing these tasks in hardware is usually accomplished by storing the cursor display control image data in a memory location independent of the display data and then tracking the location of the cursor via location data provided by the mouse or other location control instrument. The hardware then combines the display data and cursor display control data and maps them to the display. The monitoring and coordination of these tasks by the computer system's microprocessor or microprocessors consume valuable processing time and thus decreases the overall efficiency of the computer system.

Finally, the hardware superimposes the cursor over display images. Blending the cursor with the display image would allow the foreground to be visible with a transparent cursor. Blending by the computer system's microprocessor or microprocessors would further consume valuable processing time.

Thus, there is a further need in the technology for providing a blending operation which provides a blend of the cursor foreground and background colors with the displayed image colors as specified by the user. There is also a need for providing such a blending operation for a cursor which is processed in single pixel increments while other display information provided on the same display is processed in multiple pixel sections. Furthermore, there is a need to relieve the microprocessor from having to monitor this blending operation so as to increase the overall efficiency of the computer system.

BRIEF SUMMARY OF THE INVENTION

Based on the foregoing, an apparatus and method for processing display data in multi-pixel sections, which also tracks and maps a cursor in single pixel increments, is provided. A video buffer card receives display data sufficient to generate display control data for a multi-pixel section of display frame, and cursor display information including cursor enable information, cursor color selection information, cursor color and blending information, and X and Y cursor location information. Additionally, the current horizontal and vertical location of the multi-pixel section of the display data is tracked and used in combination with the cursor X and Y location information to calculate an offset that is used to replace certain portions of the display data with cursor color information. The video buffer card also supports a blending operation which provides a blend of the cursor foreground and background colors with the displayed image colors.

BRIEF DESCRIPTION OF THE DRAWINGS

These and other features of the invention will now be described with reference to drawings of a preferred embodiment, which is intended to illustrate, and not to limit, the invention, and in which.

DETAILED DESCRIPTION OF THE PREFERRED EMBODIMENT

On aspect of the present invention relates to a method and apparatus for generating display control information that simultaneously processes image display data representing more than one pixel while also allowing cursor display data to be introduced in single pixel increments. The present invention also utilizes cursor location data and cursor layout information to construct the cursor "on the fly" within a video frame buffer card. The video frame buffer card is additionally used to render the display control data for drawing an image on the display screen.

Another aspect of the present invention relates to an apparatus and method for blending of the colors the cursor and a displayed image while processing image display data at high speed. The blending operation may be performed within a video frame buffer card, thus releasing the microprocessor from monitoring and orchestrating this task and increasing processing speed. This operation, performed in hardware, displays a weighted sum of the cursor foreground and background colors with the displayed image colors. The weights are selected by software and may be chosen such that the cursor display data is fully weighted with a value of 1.0 while the displayed image data is weighted with 0.0, rendering it invisible behind the cursor. Other combinations of weighting factors may also be selected, resulting in a blend of the cursor and the displayed image.

In the following description, various signals, logic implementations, and configuration parameters are described in detail for a preferred embodiment. It will be obvious, however, that these details are not required in order to practice the present invention. In other instances, well known devices, circuits, and arrangements are provided in block form. This is done in order to avoid unnecessarily obscuring the disclosure of the present invention.

Figure 1:
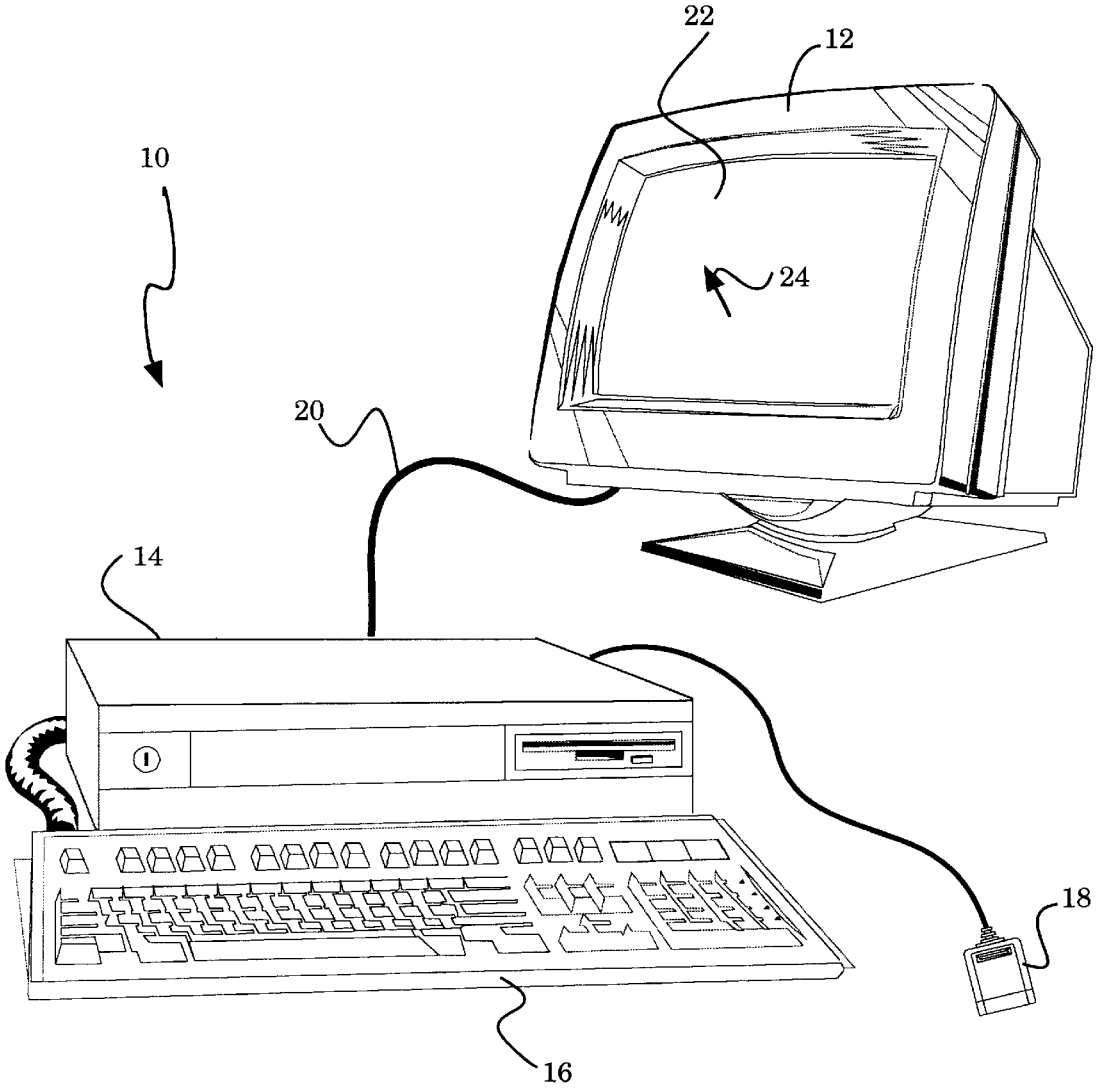
FIG. 1 is a perspective view of the external appearance of a preferred embodiment of the computer system of the present invention.

FIG. 1 illustrates a perspective view of a preferred embodiment of the computer system 10 of the present invention. The computer system 10 comprises a display monitor 12 which displays keyed-in or retrieved information such as cursor location information or color graphic elements, a computer 14 which comprises computer hardware, a keyboard 16 which permits operator input and manipulation of data and a mouse 18 which also permits operator manipulation of data. The computer 14 communicates bi-directionally with the monitor 12 via a monitor interface cable 20 as discussed in co-pending U.S. Patent Application entitled "Synchronous Serial Display Monitor Control and Communications Bus Interface" and which is incorporated herein by reference. The monitor 12 comprises a display surface 22 and signals generated by computer 14 which are transmitted through monitor interface cable 20 cause images to be generated on display surface 22 of display monitor 12. These images include cursor 24, the location of which is controlled by manipulating mouse 18.

Figure 2:
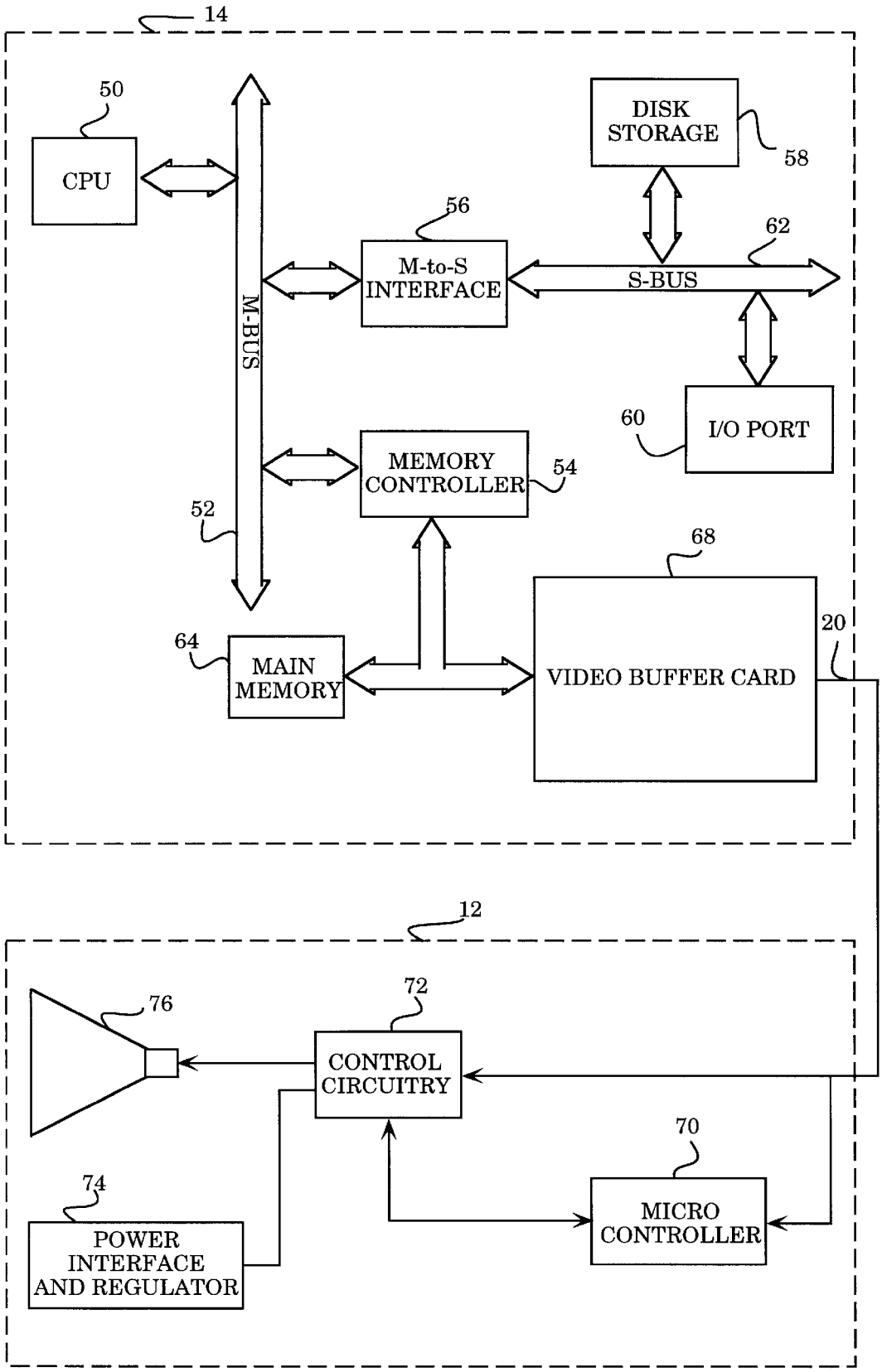
FIG. 2 is a block diagram depicting the structural elements within the computer system of FIG. 1.

FIG. 2 depicts a block diagram illustrating the internal control and processing components of the computer 14. As shown in FIG. 2, the computer 14 comprises a central processing unit (CPU) 50 such as a SUPERSPARC microprocessor. In alternate embodiments, the computer 14 may comprise two, three or four CPUs. The CPU 50 communicates bi-directionally with a processor bus or M-bus 52. The computer 14 further comprises a memory controller 54 which communicates bi-directionally with the M-bus 52, and a processor-to-Input/Output (M-to-S) interface 56 which also communicates bi-directionally with M-bus 52.

A disk storage device 58 and an Input/Output (I/O) port 60 each communicate bi-directionally with an I/O bus or S-bus 62, and the S-bus in turn communicates bi-directionally with M-to-S interface 56. Memory controller 54 interfaces M-bus 52 to main memory 64 and a video buffer card 68. The monitor interface cable 20 couples the video buffer card 68 to a micro-controller 70 and control circuitry 72 located in display monitor 12. Power is supplied to the control circuitry 72 and regulated via a power interface and regulator 74. The control circuitry 72 communicates bi-directionally with the micro-controller 70 and also controls a cathode ray tube ("CRT") 76 located within the display monitor. In an alternate embodiment, a flat panel display, the use of which is well known in the art, may be used in place of the CRT 76. Peripheral devices such as keyboard 16 and mouse 18 are coupled to computer 14 via I/O port 60.

Though not shown in FIGS. 1 and 2, the computer 14 may also be provided with a network interface such as Ethernet or a token ring, which would provide networking capabilities, for example, to a local area network (LAN) or a wide area network (WAN).

During operation, CPU 50 loads and executes program instruction sequences of a specific program loaded in main memory 64 or from software loaded in disk storage 58 and placed in main memory 64. The CPU 50 writes display data such as cursor location information to Video Buffer Card 68 via memory controller 54. The CPU 50 also receives cursor location information via I/O port 60 from mouse 18. This cursor location information is written through memory controller 54 to Video Buffer Card 68. In response to this display and cursor information, Video Buffer Card 68 generates display control data that is transmitted over monitor interface cable 20 to display monitor 12. This display control information causes display monitor 12 to generate various images on display screen 22 including cursor 24 of FIG. 1.

Figure 3:
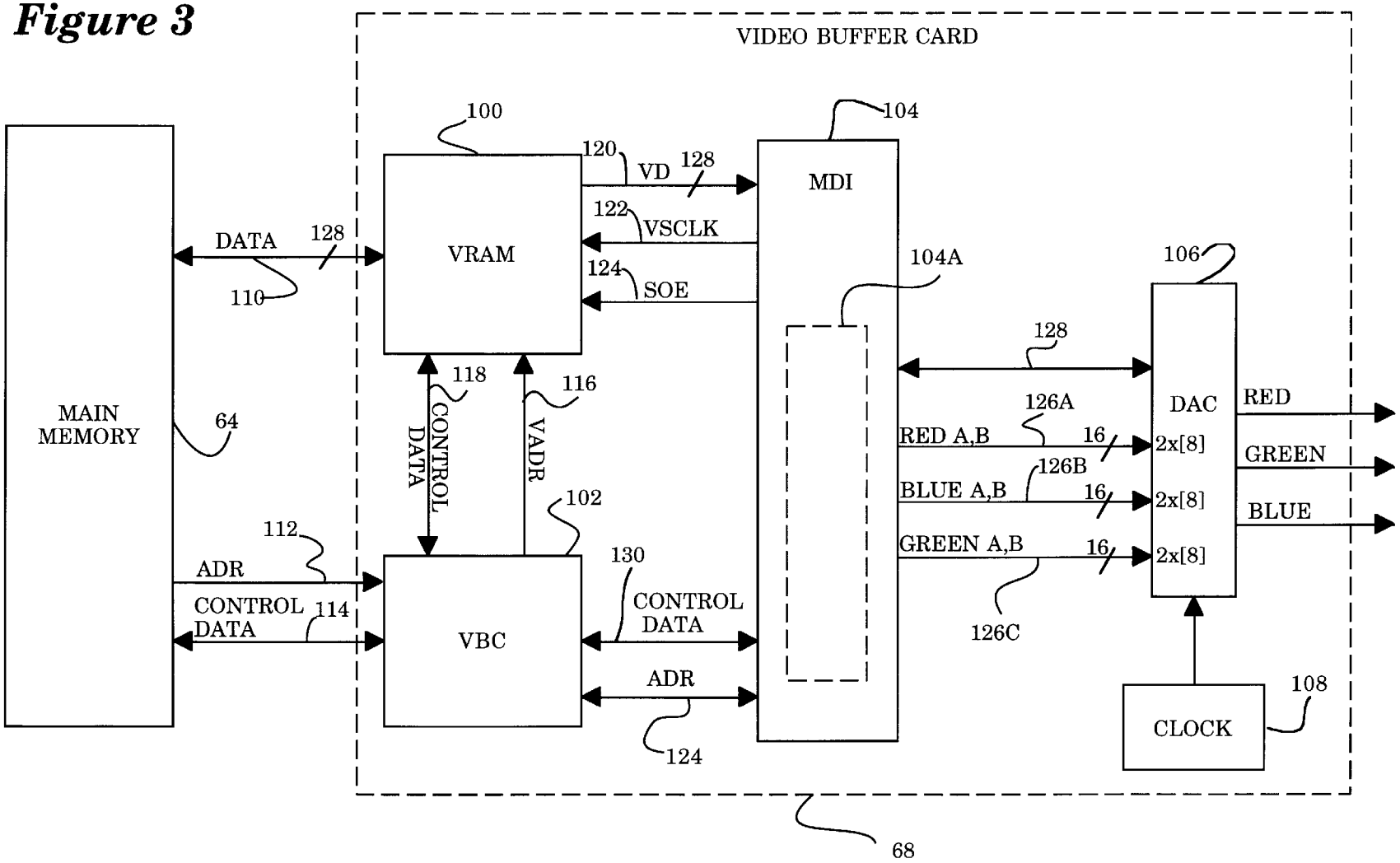
FIG. 3 is a detailed functional block diagram depicting various structural elements within the computer system of FIG. 1.

FIG. 3 is a block diagram depicting the configuration of video buffer card 68. As illustrated in FIG. 3, Video Buffer Card 68 comprises a Video Random Access Memory (VRAM) 100, a Video Buffer Chip (VBC) 102, Memory Display Interface (MDI) 104, a Digital-to-Analog Converter (DAC) 106 and a Programmable Clock Circuit 108. Main Memory 64 communicates data to VRAM 100 over a 128-bit wide data bus 110, as controlled by memory controller 54 (see FIG. 2). In one embodiment, VRAM 100 is configured into two banks, or buffers (not shown). VBC 102 receives address lines (ADR) 112 from main memory 64. In addition, VBC 102 receives control data lines 114 from main memory for performing various control functions including refresh operations for VRAM 100 and access arbitration between MDI 104 and the memory controller 54. Various well known control signals may also be utilized in the actual embodiment of the invention. VBC 102 provides addresses to VRAM 100 over address lines VADR 116. VBC 102 also communicates control data bi-directionally to VRAM 100 over control data lines 118.

MDI 104 comprises Display Control Circuit 104*a*. MDI 104 receives data from VRAM 100 over a 128-bit wide data bus 120 and generates display data corresponding to red, blue and green values for each pixel. MDI 104 provides the display data thus generated to DAC 106 over data lines 126*a–c*. The display data for each color is composed of a first set "A" and a second set "B" of data signals each having eight bits of data for a total of 48 signals. Each set of A and B display data comprises 24 bits of red, green and blue display data. In addition, MDI 104 provides clocking signals via line 122 and a set of buffer selection signals on line SOE 124 to VRAM 100. Clock circuit 108 applies a 216 megahertz signal to DAC 106 which generates voltage levels corresponding to red, green and blue, as well as a synchronization signal on line 128, for synchronizing data transmitted from the display data from MDI 104.

In operation, MDI 104 transmits a set of clocking signals on VSCLK line 122, and a set of buffer selection signals on SOE line 124 to VRAM 100. These signals cause the display data to be read out in a predetermined order from one of the two buffers in VRAM 100. The display data is used by Display Control Circuit 104*a* to generate the data signals provided to DAC 106 over lines 126*a–c*, as will be described in detail in the following sections. Additionally, control data and other display information including the cursor location, cursor color plane, and cursor enable plane received by VBC 102 through data lines 114 is transmitted to MDI 104 via data lines 130. VBC 102 also controls VRAM 100 such that updates of new display and control information from CPU 50 of FIG. 2 are performed on the buffer in VRAM 100 not currently being read by MIDI 104. Once all the data in one of the buffers of VRAM 100 has been clocked out of VRAM 100, representing a complete frame of data, the data buffer selection signals are switched and the second buffer of VRAM 100 is clocked into MIDI 104. VBC 102 then updates the first buffer of VRAM 100 using data provided by CPU 50.

Figure 4A:
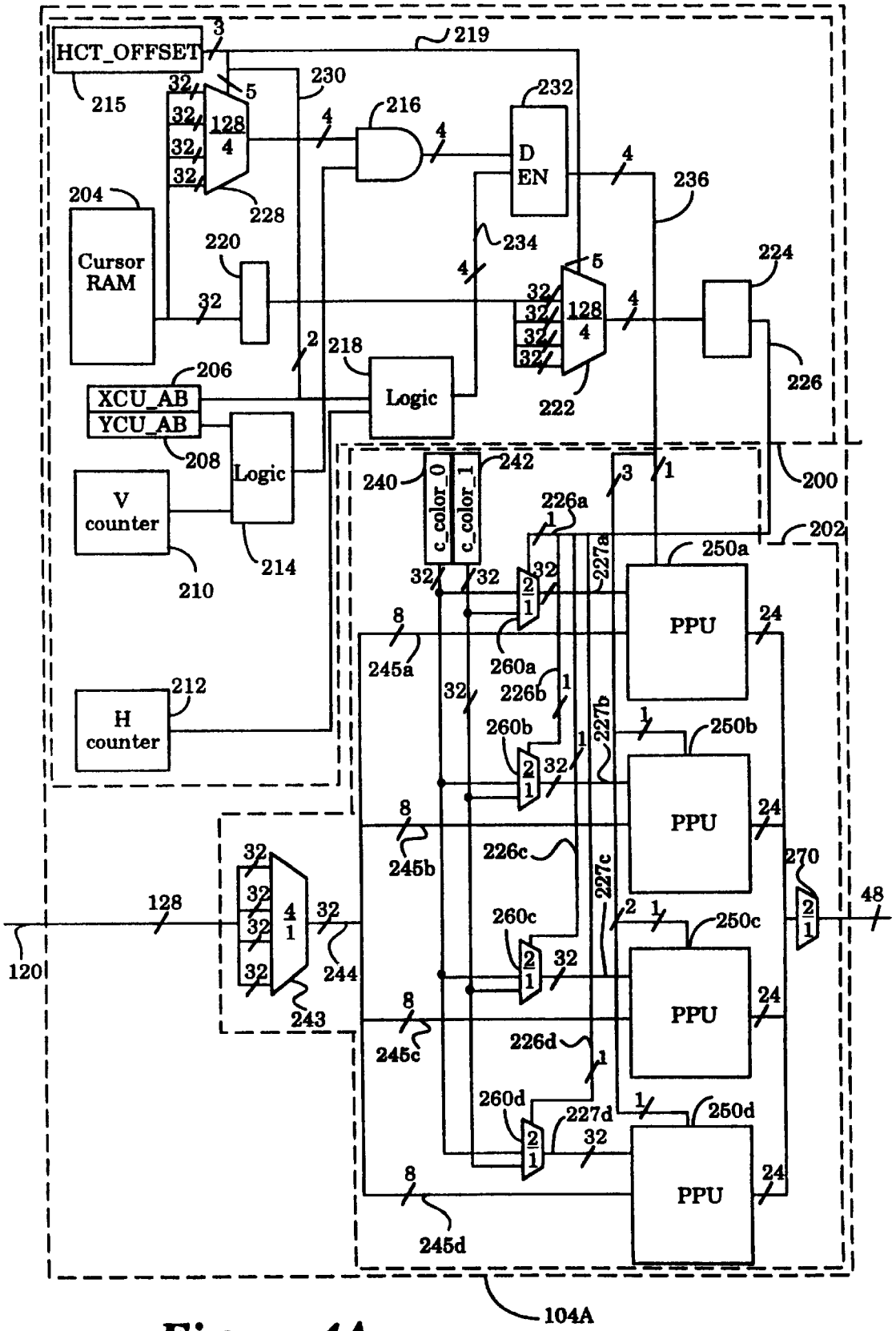
FIG. 4A is a detailed block diagram depicting the structural elements of the display control circuit 104*a* of FIG. 3 configured to operate in eight-bit mode.
Figure 4B:
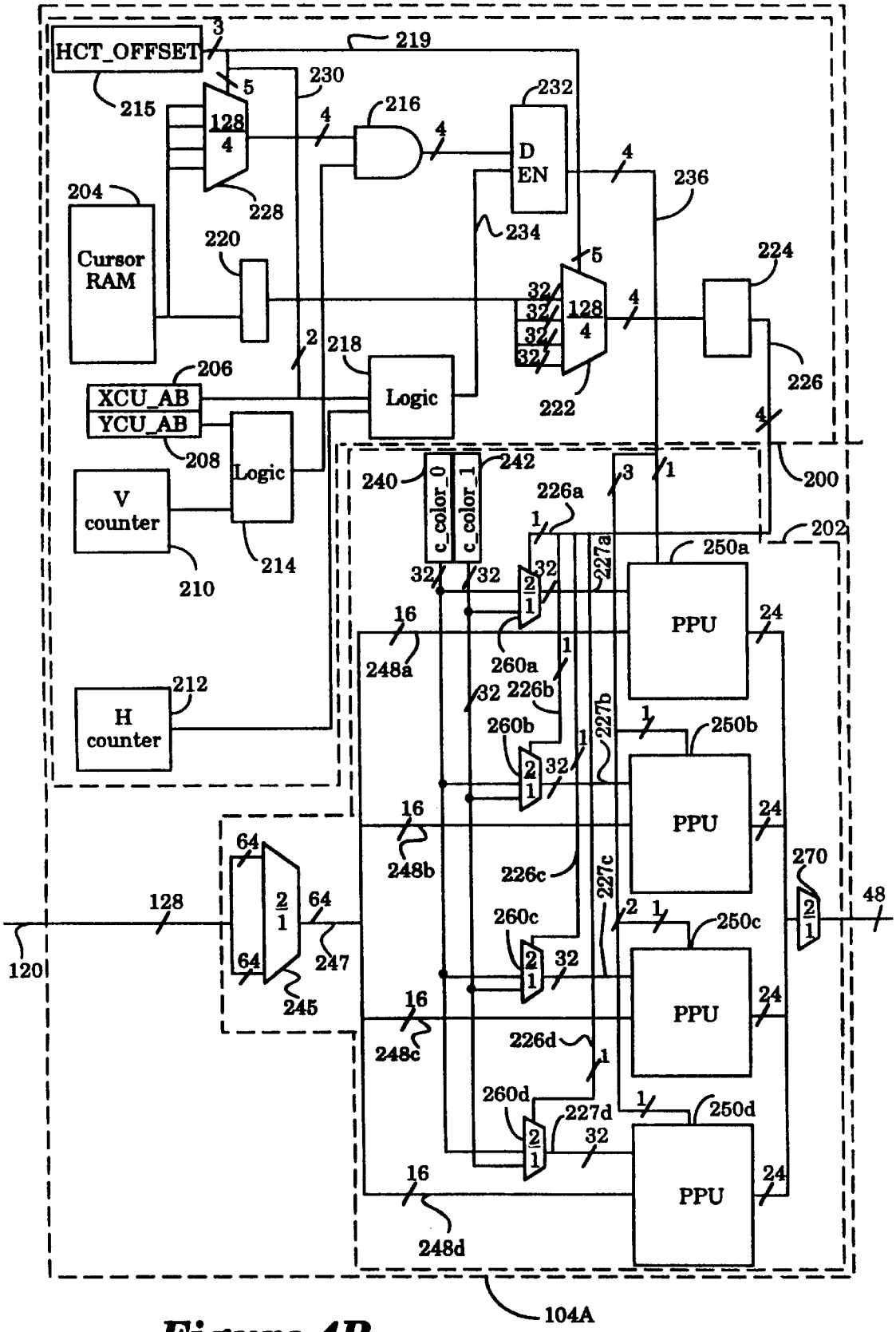
FIG. 4B is a detailed block diagram depicting the structural elements of the display control circuit 104*a* of FIG. 3 configured to operate in sixteen-bit mode.
Figure 4C:
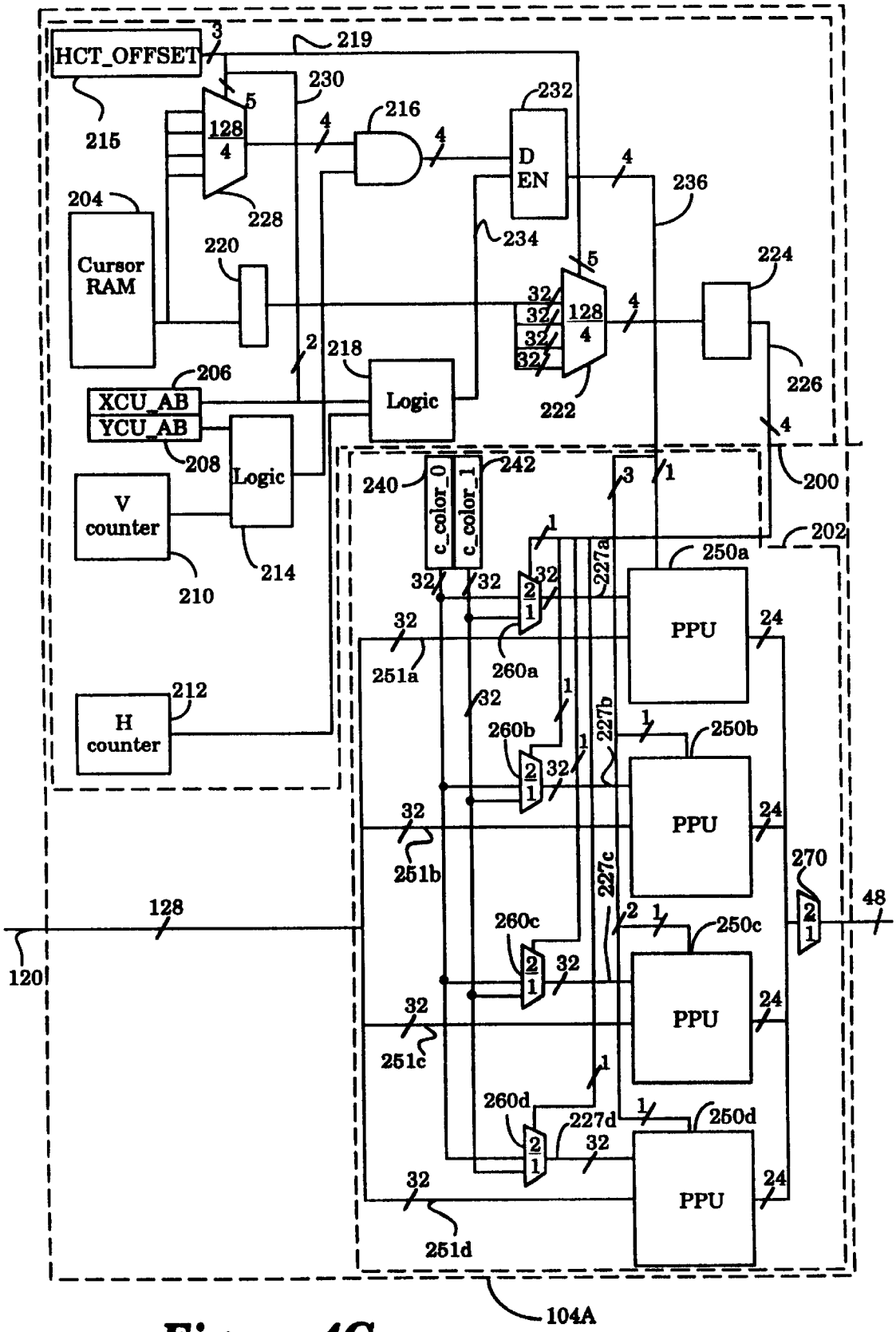
FIG. 4C is a detailed block diagram depicting the structural elements of the display control circuit 104*a* of FIG. 3 configured to operate in thirty-two bit mode.

FIGS. 4A–C are block diagrams depicting the structural elements of the Display Control Circuit 104*a* of MDI 104 configured to operate in eight-bit (FIG. 4A), sixteen-bit (FIG. 4B) and thirty-two (FIG. 4C) bit mode. The selection of each mode of operation may be predetermined by software or user-specified. The circuitry in each mode is identical, with the exception of the use of a four-to-one multiplexer in eight bit mode, and the use of a two-to-one multiplexer in sixteen bit mode to provide data from VRAM 100 to Digital Control Circuit 104*a* in eight bit and sixteen bit format respectively. In thirty-two bit mode, no such multiplexers are utilized. A detailed description of each mode of operation will be provided in the following sections.

In each mode, the Digital Control Circuit 104*a* utilizes display information stored in VRAM 100 and the cursor information provided via VBC 102 to generate the displayed image. In the present embodiment, Digital Control Circuit 104*a* comprises a Cursor Processing Unit 200 and a Color Processing Unit 202. The Cursor Processing Unit 200 comprises circuitry which determines whether the current position in scanning a frame is occupied by the cursor and selects the 2 colors used to display the cursor foreground and background. Color Processing Unit 202 processes display control data and cursor data to create the 24-bit display control data which will drive the display monitor.

Cursor Processing Unit 200 comprises a cursor RAM (CRAM) 204, an XCU_AB register 206, a YCU_AB register 208, a vertical (V) counter 210 and a horizontal (H) counter 212. V counter 210 and H counter 212 respectively track the vertical and horizontal location of the current set of pixels being drawn. In the present embodiment, the pixel sections are configured in a horizontal row of four. Therefore, the count generated by horizontal counter 212 increases in four pixel increments at one time. Other embodiments of the invention may use different multi-pixel configurations. CRAM 204 contains 32 bits by 64 bits of data representing cursor enable and color information stored in two 32 bit by 32 bit blocks. XCU_AB register 206 and YCU_AB register 208 are internal registers which store information regarding the current X and Y location of the cursor in single pixel increments transmitted to MDI 104 via VBC 102 (FIG. 3). Cursor Processing Unit 200 further comprises the HCT_OFFSET signals 215 which are generated from the three least significant bits of the difference between the value from H counter 212 and the nine most significant bits of XCU_AB register 206.

The values in the V counter 210 and the YCU_AB register 208 are simultaneously going into logic circuit 214. The output of logic circuit 214 is provided as one input to four AND gates 216. The values from H counter 212 and register XCU_AB 206 are going into logic circuit 218 which in turn outputs four separate lines, one for each pixel. Cursor color select information stored in CRAM 204 is provided via a 32-bit wide bus to latch circuit 220. The output of latch circuit 220 are 32 unique signals. These signals are provided as input to 128-to-4 multiplexer 222. Multiplexer 222 subsequently provides its output to latch circuit 224 which in turn generates a set of four cursor color select signals via signal lines 226*a–d*.

In addition, cursor enable information for the current cursor row is provided to the 128-to-4 multiplexer 228. The four outputs from the 128-to-4 multiplexer 228 contain cursor enable information for four or less valid cursor pixels. These four outputs are then provided as a second input to the 4 AND gates 216. The output of the AND gates 216 is provided on a 4-bit wide bus to a latch circuit 232, which is enabled by the output of logic circuit 218 via signal line 234. The output of the latch circuit 232 is provided to Color Processing Unit 202 via the Cursor Enable signal line 236. The multiplexers 228 and 222 select their respective outputs based on a 5-bit control word created using the HCT_OFFSET and XCU_AB registers 215, 206. The three least significant bits of the word are provided by the HCT_OFFSET register 215. The two most significant bits of the control word are taken from the two least significant bits of XCU_AB register 206. These two multiplexers 228, 222 are used to step through the cursor image which lies within a multi-pixel group.

The Color Processing Unit 202 comprises two cursor color registers (c_color_0, c_color_1) 240, 242, and four identical pixel processing units (PPUs) 250*a–d*. Cursor color register zero (c_color_0) 240 and cursor color register one (c_color_1) 242 store two thirty-two bit color codes used to draw the cursor 26 of FIG. 1. As a particular display frame of data is being drawn the 128 bits of data representing a horizontally configured set of four pixels are read into PPUs 250*a–d*. In the eight bit mode as depicted in FIG. 4A, the 128 bits of data provided by line 120 are provided via four thirty-two bit lines to a four-to-one multiplexer 243. The output of the multiplexer 243 provides a single thirty-two bit line 244 which is consequently subdivided into four eight bit lines 245*a–d*. Each of the four lines 245*a–d* are provided to each PPU 250*a–d* respectively.

In the sixteen bit mode as depicted in FIG. 4B, the 128 bits of data provided by line 120 are provided via two sixty four bit lines to a two-to-one multiplexer 246. The output of the multiplexer 246 provides a single sixty four bit output on line 247, which is consequently subdivided into four sixteen bit lines 248*a–d*. Each of the four lines 248*a–d* are provided to PPU 250*a–d* respectively.

In the thirty-two bit mode as depicted in FIG. 4C, the 128 bits of data provided by line 120 are provided via thirty-two bit lines 251*a–d* to each PPU 250*a–d* respectively.

In addition, the value stored in either one of cursor color registers 240 and 242 is applied to each PPU 250*a–d* through multiplexers 260*a–d* respectively. The multiplexers 260*a–d* are controlled via cursor color selects lines 226*a–d* generated by latch circuit 224. Whether each PPU 250*a–d* generates display control data based on the display data or the cursor color data depends on the state of the Cursor Enable lines 236*a–d* applied. Each PPU 250*a–d* processes color data for each set of pixels, as will be described in detail in the following sections. The output of PPUs 250*a–d* are multiplexed by multiplexer 270 to provide two sets of 24-bit data.

The operation of Cursor Processing Unit 200 will now be described. During a horizontal synchronization period, which corresponds to the start of a new horizontal line being drawn, thirty-two bits of cursor color select information from CRAM 204 are latched in by latch circuit 220. While not in horizontal synchronization, thirty-two bits of cursor enable information from CRAM 204 are applied to 128-to-4 multiplexer 228. In both cases, the data is organized such that selection for output by a multiplexer passes on the first set of four or less valid pixels of the cursor's image, then the next four or less valid pixels, until the final set of four or less valid pixels.

Logic circuit 214 determines when the current value of vertical counter 210 is greater than or equal to the current value in YCU_AB register 208 and less than or equal to the value YCU_AB register 208 plus 32, which corresponds to the vertical area occupied by cursor 24. When such a condition is true, logic 214 asserts a logic high to AND gate 216 which allows the currently selected four bits of cursor enable data from multiplexer 228 to pass onto latch circuit 232. Logic circuit 218 determines, on a pixel by pixel basis, when the value generated by H counter 212 is greater than or equal to the value stored at XCU_AB register 206 and is less than or equal to the value stored in XCU_AB register 206 plus 32, and asserts a logic high on the enable inputs of latches 232 in response. The combination of the 128-to-4 multiplexer and logic 218 allows for cursor data to be processed in single pixel precision when dealing with display data in multiple pixel sections. The 128-to-4 multiplexer 222 receives the output of latch circuit 220 in four different configurations and is controlled by the combination of HCT_OFFSET and the lower two bits of XCU_AB 206 in a similar manner to multiplexer 228. The output of multiplexer 222 is applied to D latches 224 which in turn generates a set of four cursor color select signals 226. The four color selection control bits are applied to color selection multiplexers 260*a–d* which receive the two thirty-two bit color codes of cursor color registers 240 and 242, and apply one of these colors to each of PPUs 250*a–d* respectively, depending on the state of the respective color selection control bit.

The operation of Color Processing Unit 202 will now be described. As a particular display frame of data is being drawn the 128 bits of data representing a horizontally configured set of four pixels are read into PPUs 250*a–d*. In the eight bit mode configuration as depicted in FIG. 4A, the 128 bits of data are multiplexed by multiplexer 243 to provide 32 bits of data on line 244. Line 244 is further divided into four lines each providing 8 bits of data to each PPU 250*a–d*. In the sixteen bit mode configuration as depicted in FIG. 4B, the 128 bits of data provided from VRAM 100 via line 120 is multiplexed by two-to-one multiplexer 246 to provide 64 bits of data on line 247. These 64 bits of data are provided on four lines 248*a–d*, each providing 16 bits of data to each PPU 250*a–d*. In the thirty-two bit mode configuration as depicted in FIG. 4C, the 128 bits of data are provided by four lines 251*a–d* each carrying 32 bits of data, to PPUs 250*a–d*. In this manner, 8 bits of data may be processed by PPUs 250*a–d* in the eight bit mode configuration, sixteen bits of data may be processed by PPUs 250*a–d* in the sixteen bit mode configuration and thirty-two bits of data may be processed by PPUs 250*a–d* in the thirty-two bit mode configuration.

As described earlier, the value stored in either one of cursor color registers 240 and 242 are applied to each PPU 250*a–d* through multiplexers 260*a–d* which are controlled via cursor color selects lines 226*a–d* generated by latch circuit 224. Whether each pixel processing circuit generates display control data based on the display data only or both the display data and the cursor color data depends on the state of the Cursor Enable lines 226*a–d* applied.

Each one of the cursor enable signals produced by latch circuit 232 are applied to one of the PPUs 250*a–d*. When any one of the Cursor Enable signals 226*a–d* are asserted the corresponding PPU 250*a, b, c,* or *d* switches from processing the display data from input lines 245*a–d* in the eight bit mode (FIG. 4A) or input lines 248*a–d* in the sixteen bit mode configuration (FIG. 4B) or input lines 251*a–d* in the thirty-two bit mode configuration (FIG. 4C) to processing the data provided by both the display data and one of cursor multiplexers 260*a–d*. The two 32 bit cursor color indicator registers 240, 242 are applied to the two inputs of cursor multiplexer 260*a–d*. The cursor color select lines 226*a–d* are applied to the control input of these multiplexers 260*a–d* and determines which of the two colors is applied the corresponding pixel processing pipeline circuit. Each PPU 250*a–d* generates 24 bits of display data comprised of 8 bits of red, 8 bits of blue and 8 bits of green data. The 24 bits of data thus generated are provided to a two-to-one multiplexer 270, which in turn generates two sets of 24 bits of color data.

The display control data generation circuit Digital Control Circuit 104*a* provides a variety of configurations for generating display control data that can be utilized with a wide variety of display data storage formats including 8, 16 and 32 bit per pixel formats. Additionally, it allows multiple color look-up tables to be implemented and then blended allowing for smooth combinations of two portions of a particular display frame utilizing different color look-up tables. The circuit can be configured for 32 bit true color display, or multiple bit gray scale configurations. Digital Control Circuit 104*a* also allows introduction of cursor data at the later stages of display data processing such that the cursor data generation process and the display data generation process can be performed separately and in parallel. The result is a high quality display system that utilizes less expensive VRAM memory and can place a cursor on the display in single pixel increments.

Figure 5A:
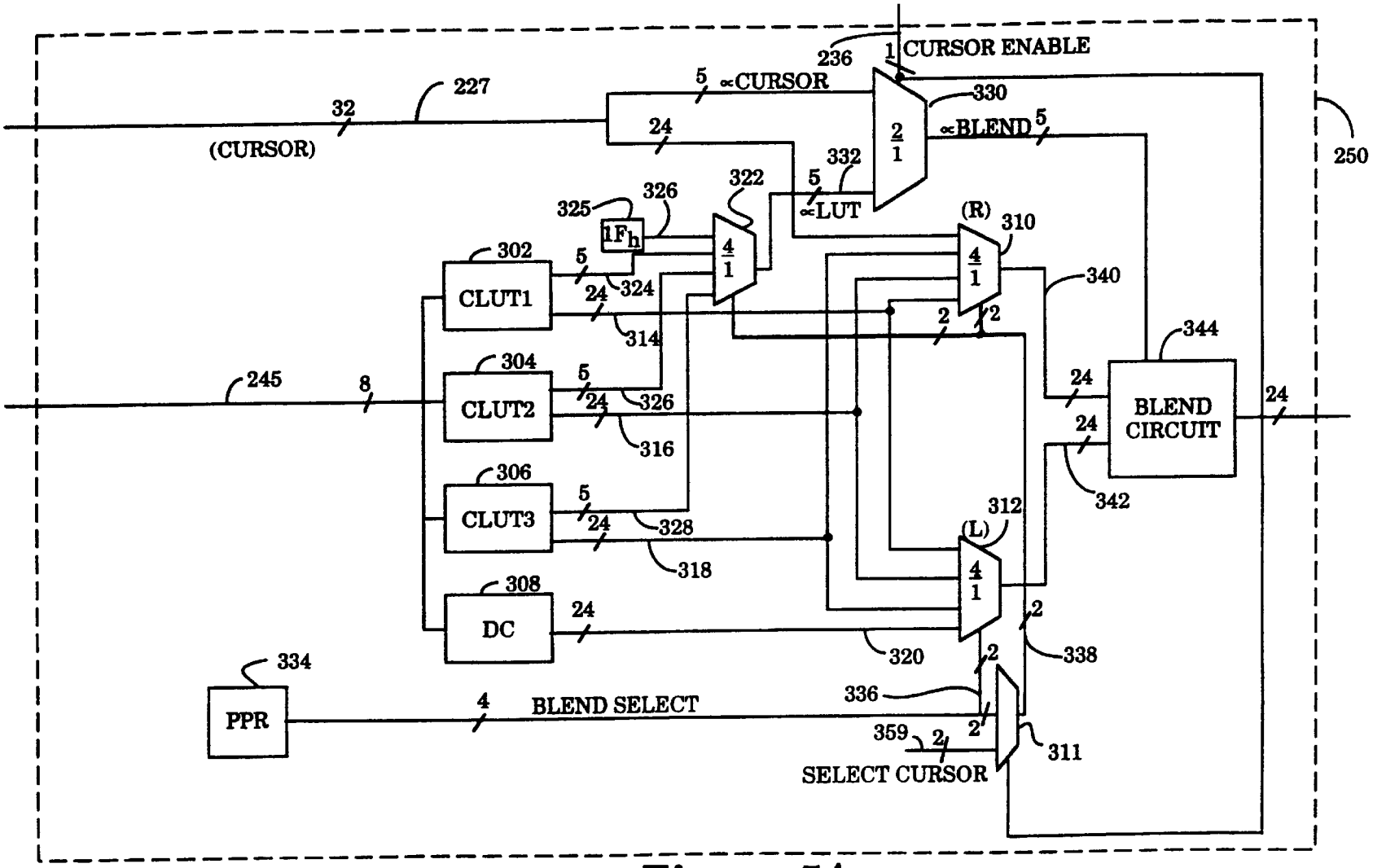
FIG. 5A is a detailed block diagram depicting the structural elements of the pixel processing unit 250 of FIG. 4A.
Figure 5B:
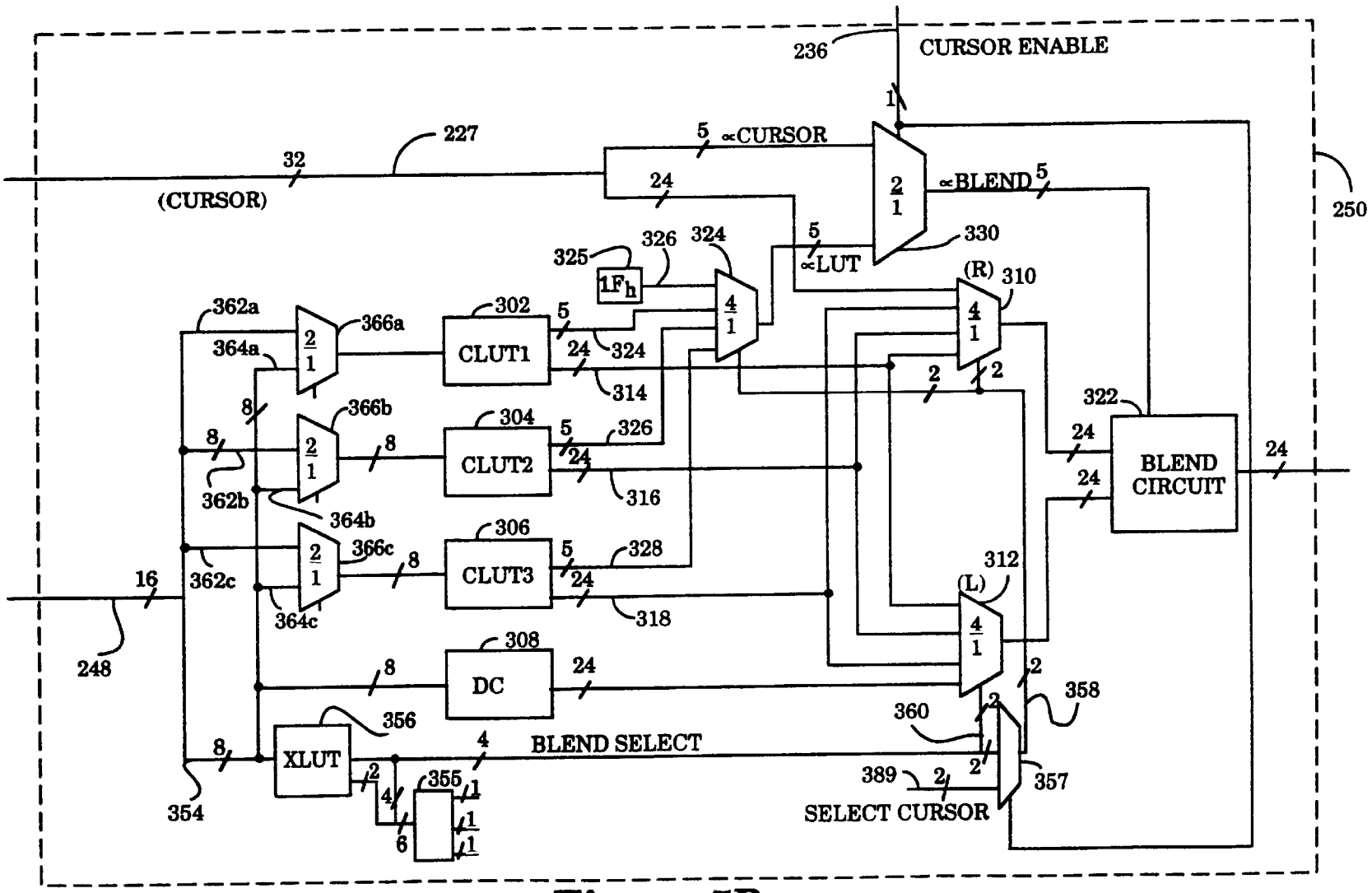
FIG. 5B is a detailed block diagram depicting the structural elements of the pixel processing unit 250 of FIG. 4B.
Figure 5C:
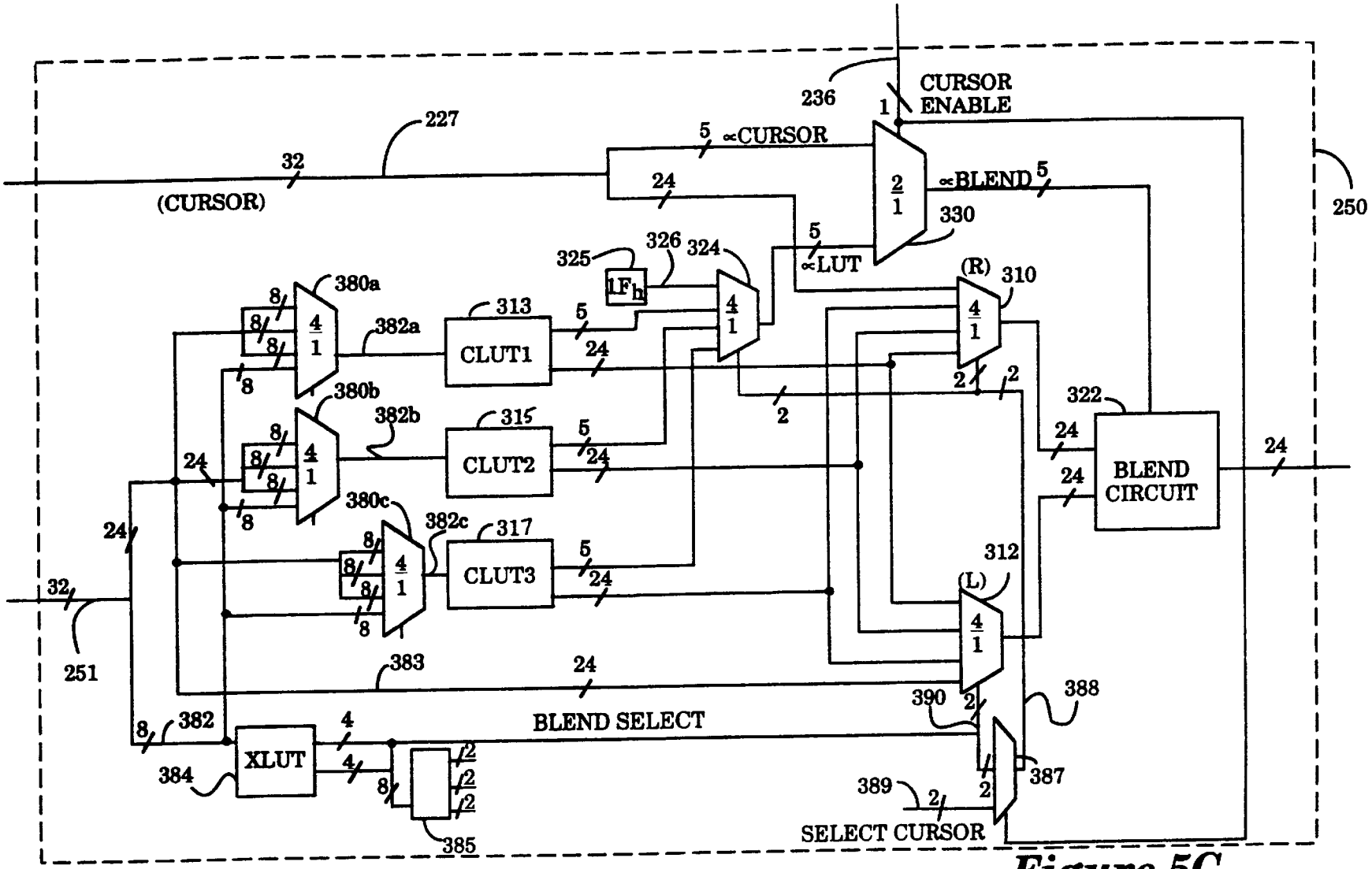
FIG. 5C is a detailed block diagram depicting the structural elements of the pixel processing unit 250 of FIG. 4C.

FIG. 5A–C are block diagrams illustrating one of the PPUs 250*a–d* configured to operate in eight, sixteen or thirty-two bit mode respectively. For present purposes, and since the PPUs 250*a–d* are identical for each mode of operation, the PPU described in the following sections is representative of each PPU 250*a–d* for a particular mode, and will be referred to as PPU 250. Additionally, signal lines provided to each PPU 250*a–d*, such as 245*a–d*, 227*a–d* and 236*a–d* will be referred to as 245, 227 and 236 where the lines are applied to the representative PPU 250.

FIG. 5A depicts a block diagram of PPU 250 configured to operate in eight-bit mode. In this mode, four bits of control data generated by a Packed Pixel Register (PPR) select colors from among three look up tables and a direct circuit, to be blended together, as will be described in detail in the following sections. In an alternate embodiment, the selection may be made from between two look up tables.

In this configuration, PPU 250 comprises three color look-up tables (CLUTs), namely, CLUT1 302, CLUT2 304, CLUT3 306 and a Direct Circuit (DC) 308, each of which receive eight bits of display control data from VRAM 100 via line 245. The most significant 24 bits of data outputted by each CLUT 302, 304, 306 contain color information, and are provided to two four-to-one multiplexers 310, 312 via signal lines 314, 316, 318. Twenty-four bits of cursor data are also provided to multiplexer 310. In the present embodiment, multiplexer 310 serves as the Right channel and multiplexer 312 serves as the Left channel. All 24 bits of data provided by circuit 308 contain color information and are provided to multiplexer 312. Of the remaining eight bits, five bits are provided by CLUTs 302, 304, 306 to four-to-one multiplexer 322 via signal lines 324, 326, 328 respectively. These five bits contain blend ($\alpha$) information. PPU 250 also comprises a hard wired value 325 which is provided to multiplexer 322 via signal line 326. This hard-wired value 325 is the highest value of $\alpha$. In a preferred embodiment, this value is $1F_h$. The output of the multiplexer 322 is provided as one input to a two-to-one multiplexer 330 via signal line 332. The PPU 250 further comprises a Packed Pixel Register (PPR) 334 which generates four bits of control data of which two bits are provided via signal line 336 to multiplexer 312 and two bits are provided to multiplexer 311. Multiplexer 311 also receives one bit of cursor enable data from line 236 and two bits of hardwired select cursor data via select cursor line 359. The multiplexer 311 outputs two bits of data which are provided to multiplexer 310 and multiplexer 322. PPR 334 is only used in eight bit mode and cannot be changed on a per pixel basis. When the cursor is enabled (via line 236), the hardwired value (provided via select cursor signal line 359) is selected which enables the multiplexer 311 to send a signal to multiplexer 310 to select cursor data provided on line 227. When the cursor is not enabled, multiplexer 310 obtains blend select information from PPR 334 to select the implementation of color data from among CLUTs 302, 304 and 305. At the same time, the two bits of control data provided to multiplexer 322 (when the cursor is not enabled) cause multiplexer to select a blend ($\alpha$) value from among: CLUT1 302, CLUT2 304, CLUT3 306 and the hardwired value 325.

Of the data provided by signal line 227 from either of the cursor color registers 240 or 242, the least significant twenty-two bits are provided as one input to multiplexer 310. Of the remaining 8 bits, the most significant 5 bits contain information regarding the blending ratio $\alpha$ required for blending the two graphical elements. These 5 bits are provided as another input to multiplexer 330, which also receives a Cursor Enable signal from signal line 236. The output of each multiplexer 310 and 312 are provided via lines 340, 342 to Blend Circuit 344. The output of multiplexer 330, which provides the selected blending ratio $\alpha$, is also provided to Blend Circuit 344, which generates a single output of 24 bits of color display data.

Once the 8-bit mode has been selected, PPR 334 will provide MDI 104 with information on how to process all incoming pixels. In the present embodiment, there are four options for processing incoming pixels. First, pixel data may be unaltered and provided identically to the outputs on each PPU 250 upon channeling the data through DC 308. The other three options include the use of the three color look up tables (CLUT1 302, CLUT2 304 and CLUT3 306), where the 8 bits are mapped into 24 bits, producing 24 bit indexed color, as is well known in the art. The selection of the options is determined by the PPR 334, as will be described in detail below.

In operation, each of the 8 bits of pixel data are provided via line 245 to CLUT1 302, CLUT2 304, CLUT3 306 and DC 308. Each of the CLUTs 302, 304, 306 map the 8 bits of incoming pixel data into 24 bits of indexed color. This data is provided over lines 314, 316 and 318 to four-to-one multiplexers 310 and 312. Twenty-four bits of cursor color data are also provided to multiplexer 310. DC 308 which also provides 24 bits of data to multiplexer 312 implements a gray scale display whereby each of the red, green and blue color intensities are set to an equal level and equal to 8 bits of the input display data provided via line 245. When in 8 bit mode, PPR 334 generates blend select control signals which are applied to multiplexers 311 and 312 to select color data as described above.

Blend Circuit 344 performs a blending of the colors provided by the two multiplexers 310, 312 to produce 24 bits of color display data comprising red, blue and green display data. The weighting used in the blending of the colors is determined by the blending ratio $\alpha$ and in the present embodiment, it varies from 0 to 1 (i.e., 0% to 100%). In the present preferred embodiment, the formula used in calculating the blending is as follows:

$$\text{Output pixel value} = \alpha\ \text{Left} + (1-\alpha)\text{Right}$$

where $\alpha$ is the blending ratio;

Left is the output of the left channel; and

Right is the output of the right channel.

Thus, whenever the cursor 24 is enabled at a current pixel location, the active cursor will be blended with the current pixel. If the cursor is not active at the current pixel location, Blend Circuit 344 will perform a blending of the two pixel channels selected.

FIG. 5B depicts a block diagram of PPU 250 configured to operate in sixteen-bit mode. In this mode, the high order byte of the incoming pixel is used to direct the MDI 104 in processing a particular pixel. This high order byte, or the eight bits are referred to as the X-bits, and are processed through the X Look Up Table (XLUT) as will be described in detail below.

In this configuration, PPU 250 receives sixteen bits of data via line 248. Of these sixteen bits of data, eight of the most significant bits are provided via line 354 to X Look Up Table (XLUT) 356. XLUT 356 in turn generates six bits of control data for controlling the selection of color data, as will be described in detail below. The sixteen bits of data are also provided via lines 362*a*–362*c*, 364*a*–364*c* to two-to-one multiplexers 366*a*–366*c*, which provide eight bits of data to each of three CLUTs 302, 304, 306 respectively. DC 308 obtains the most significant byte of the 16 bits from line 248 via line 354 and then splits this byte or eight bits into 24 bits of data, which are then provided to multiplexer 312. As in the eight bit mode, the least significant 24 bits of data provided by each CLUT 302, 304, 306 contain color information and are provided to two four-to-one multiplexers 310, 312 via signal lines 314, 316, 318. Twenty-four bits of cursor data are also provided to multiplexer 310. All 24 bits of data provided by DC 308 contain color information and are provided to multiplexer 312. Of the remaining eight bits, five bits outputted by CLUTs 302, 304, 306 contain blend information and are provided to four-to-one multiplexer 324 via signal lines 324, 326, 328 respectively. PPU 250 also comprises a hardwired value 325 which is the highest value of α. In the presently preferred embodiment, this value is $1F_h$. The hardwired value 325 is provided as an input to multiplexer 324 via signal line 326. The output of the multiplexer 324 is provided as one input of a two-to-one multiplexer 330 via signal line 332.

As described earlier, XLUT 356 receives the highest 8 bits from the 16 bits of display data and generates a set of six control signals in response. The six control signals are provided to circuit 355 which generates three select signals for each of the multiplexers 366*a*–366*c*. Of these six control signals, four are blend select signals. Of the four blend select signals, two are provided via signal line 360 to multiplexer 312 and the other two are provided to multiplexer 357. The multiplexer 357 also receives cursor enable data from line 236 and two bits of hardwired data via line 389. The multiplexer 357 outputs two bits of data which are provided to multiplexers 310 and 324. When the cursor is enabled (via line 236) the hardwired value (via select cursor line 389) enables multiplexer 357 to send a signal to multiplexer 310 to select cursor data from line 227. When the cursor is not enabled, multiplexer 310 obtains blend select information via the blend select line from XLUT 356 to select implementation of color data from among CLUTs 302, 304 and 306. When the cursor is not enabled, the two bits of control data provided to multiplexer 324 cause multiplexer 324 to select a blend (α) value from among: CLUT1 302, CLUT2 304, CLUT3 306 and the hardwired value 325. XLUT 356 is used in display configurations in which sixteen bits per pixel are implemented and allows the various multiplexer control signals to be changed on a per pixel basis.

In operation, each of the 16 bits of pixel data are provided via line 248 to two-to-one multiplexers 366*a*–366*c* which each output 8 bits of data to CLUT1 302, CLUT2 304, CLUT3 306. DC 308 receives eight bits of data. As in the eight bit mode configuration, each of the color look up tables 302, 304, 306 map the 8 bits of incoming pixel data into 24 bits of indexed color and provide each 24 bits of data to four-to-one multiplexers 310 and 312. Twenty-four bits of cursor color data are also provided to multiplexer 310. DC 308 which also provides 24 bits of data to multiplexer 312 provides a gray scale display whereby each of the red, green and blue color intensities are set to an equal level and controlled by 8 bits of the input display data. When in 16 bit mode, XLUT generates the blend select control signals which are applied to multiplexers 357 and 312 to select color data from among the CLUTs 302, 304, 306 or DC 308 or from cursor data provided via line 227 as described above. Blend Circuit 344 performs a blending of the colors provided by the two multiplexers 310, 312 in the same manner as for the eight bit mode configuration described earlier.

Thus, in the 16 bit mode, separate 8 bit channels of color data can be mapped into a single output pixel. By changing the X-information of this pixel, the channels can be blended with each other, individually selected or disabled. In this manner, separate channels can be blended together at different alpha values for each pixel (physical location on the screen).

FIG. 5C depicts a block diagram of PPU 250 configured to operate in thirty-two bit mode. In this mode, as in the sixteen bit mode, the high order byte of the incoming pixel is used to direct the MDI 104 in processing a particular pixel.

The circuitry in this configuration is similar to that of the sixteen bit configuration, with the exception of the manner in which incoming data is provided to each CLUT 313, 315, 317. In this configuration, PPU 250 receives thirty-two bits of data via line 251. Four-to-one multiplexers 380*a*–380*c* each receive the thirty-two bits of data and multiplexes the data to provide eight bits of data via signal lines 382*a*–382*c* to each of three color look-up tables 313, 315, 317. Of the thirty-two bits of incoming bits of data, twenty-four bits of the data are provided directly to multiplexer 312. XLUT 384 receives the most significant eight bits from the 32 bits of display data provide via line 251 and generates a set of eight bits of control data in response. Of these, four bits are blend select data of which two are provided to multiplexer 312 via line 390 and the remaining two are provided to multiplexer 387. Blending information is also provided to the Blend Circuit 322 in the same manner as in the eight and sixteen bit mode configurations.

In operation, each of the 32 bits of pixel data are provided via line 251 to four-to-one multiplexers 380*a*–380*c* which outputs eight bits of data to CLUT1 313, CLUT2 315 and CLUT3 317. As in the eight and 16 bit mode configuration, each of the color look up tables 313, 315, 317 map the eight bits of incoming pixel data into 24 bits of indexed color and provide each 24 bits of data to four-to-one multiplexers 310 and 312. Twenty-four bits of cursor color data are also provided to multiplexer 310. Line 383 provides 24 bits of true color data to multiplexer 312. XLUT 384 receives the highest eight bits of the 32 bits of display data and generates a set of eight control signals in response. These eight signals are provided to circuit 385 which generates three sets of two select signals for enabling each of the multiplexers 380*a*–380*c*. Of the eight control signals generated, four are blend select signals. Of these four blend select signals, two are provided via line 390 to multiplexer 312 for selecting the implementation of color data from among the CLUTs 313, 315, 317 or via line 383. The other two are provided to multiplexer 387. The multiplexer 387 also receives cursor enable data from line 236 and two bits of hardwired data via line 389. Multiplexer 387 provides two bits of control data to multiplexers 310 and 324.

When the cursor is enabled (via line 236) the hardwired value (via select cursor line 389) is selected which enables multiplexer 387 to provide a signal via line 388 to multiplexer 310 to select cursor data from line 227. When the cursor is not enabled, multiplexer 310 obtains blend select information via the blend select line from XLUT 384 so that multiplexer 310 can select the implementation of color data from among the CLUTs 313, 315 or 317. In addition, when the cursor is not enabled, the two bits of control data provided to multiplexer 324 cause multiplexer 324 to select a blend (α) value from among: CLUT1 313, CLUT2 315, CLUT3 317 and the hardwired value 325. Blend Circuit 344 performs a blending of the colors provided by the two multiplexers 310, 312 in the same manner as for the sixteen bit mode configuration.

Thus, a high speed display system having a cursor multiplexing scheme is described. It will be apparent to those skilled in the art that other embodiments of the invention are possible. The example provided is merely for illustration and should not be taken as limiting the scope of the invention.

What is claimed is:

1. A method for generating display control data comprising the steps of:

a) receiving display data of a multi-pixel section having at least two pixels of a display frame;

b) receiving cursor data of a cursor in single pixel increments;

c) determining if a portion of said cursor intersects one or more pixels of said multi-pixel section; and d)(1) if said portion of said cursor intersects one or more pixels of said multi-pixel section, simultaneously processing (i) said cursor data and said display data for said one or more pixels in said multi-pixel section and (ii) said display data for a remainder of said pixels in said multi-pixel section, if any, that do not intersect said cursor for display on said display frame, d)(2) otherwise, simultaneously processing said display data for each pixel in said multi-pixel section for display on said display frame.

2. The method as set forth in claim 1, further comprising the steps of:

determining whether a pixel is comprised of 8, 16, or 32 bits of said display data; and separating said display data into single pixel sections.

3. The claim as set forth in claim 1, wherein step c) further comprises the step of determining if a sub-portion of said portion of said cursor is enabled.

4. The method as set forth in claim 1, wherein step c) is comprised of the steps of:

c.1) tracking an X location and a Y location of said cursor in single pixel increments;

c.2) tracking a horizontal location and a vertical location of said multi-pixel section;

c.3) comparing said X location of said cursor with said horizontal location of said multi-pixel section and said Y location of said cursor with said vertical location of said multi-pixel section;

c.4) calculating an offset using a remainder generated in step c.3;

c.5) configuring a cursor enable data based on said offset; and c.6) applying said cursor enable data to a display processing circuit.

5. The method as set forth in claim 1, further comprising the steps of:

providing color data provided by a first color look-up table and a second color look-up table based on first and second blend select control signals;

selecting a predetermined blending ratio; and blending a first set of color data and a second set of color data based on said predetermined blending ratio to provide color display data.

6. The method as set forth in claim 1, further comprising the steps of:

providing cursor color and color data based on first and second blend select control signals, said color data provided by a look-up table;

selecting a predetermined blending ratio; and blending said cursor color and said color data based on said predetermined blending ratio to provide color display data.

7. The method as set forth in claim 1, further comprising the steps of:

providing direct color data and cursor color based on first and second blend select control signals;

selecting a predetermined blending ratio; and blending said direct color data and cursor color based on said predetermined blending ratio to provide color display data.

8. The method as set forth in claim 1, further comprising the steps of:

providing direct color data and color data based on first and second blend select control signals, said color data provided by a look-up table;

selecting a predetermined blending ratio; and blending said direct color data and said color data based on said predetermined blending ratio to provide color display data.

9. A circuit for generating display control data, comprising:

a first circuit to receive display data of a multi-pixel section of a display frame, said multi-pixel section including at least two pixels;

a cursor circuit to receive cursor data of a cursor in single pixel increments, said cursor circuit to determine if a portion of said cursor is located within a set of pixels in said multi-pixel section; and a color circuit coupled to said first circuit and said cursor circuit, said color circuit includes a plurality of pixel circuits corresponding to each pixel in said multi-pixel section, said one or more pixel circuits to simultaneously process (i) said cursor data and said display data for display on said display frame for each corresponding pixel, if any, in said multi-pixel section that intersects said cursor and (ii) said display data for display on said display frame for a remainder of pixels, if any, in said multi-pixel section that do not intersect said cursor.

10. The circuit as set forth in claim 9, further comprising:

circuitry to determine whether a pixel is comprised of 8, 16, or 32 bits of said display data and to separate said display data into single pixel sections.

11. The circuit as set forth in claim 9, further comprising:

circuitry to determine if a sub-portion of said portion of said cursor is enabled.

12. The circuit as set forth in claim 9, wherein said cursor circuit comprises:

an X location register and a Y location register to respectively track an X location and a Y location of said cursor in single pixel increments;

a horizontal counter and a vertical counter respectively to track a horizontal location and a vertical location of said multi-pixel section;

a logic circuit to compare said X location of said cursor with said horizontal location of said multi-pixel section and said Y location of said cursor with said vertical location of said multi-pixel section;

an offset register to calculate an offset using a remainder generated by said logic circuit;

a multiplexer to select a cursor enable data based on said offset; and a latch circuit to apply said cursor enable data to said plurality of pixel circuits.

13. The circuit as set forth in claim 9, wherein each pixel circuit comprises:

a first color look-up table and a second color look-up table to respectively generate a first set of color data and a second set of color data based on first and second blend select control signals;

a blending circuit to blend said first set of color data and said second set of color data based on a predetermined blending ratio to provide color display data.

14. The circuit of claim 9, wherein said color circuit includes a cursor color register to provide cursor color and wherein each pixel circuit includes a look-up table to provide color data and a blending circuit to blend said cursor color and said color data based on a predetermined blending ratio to provide color display data.

15. The circuit of claim 9, wherein said color circuit includes a cursor color resister to provide cursor color and wherein each pixel circuit includes a direct color circuit to provide a direct color and a blending circuit to blend said direct color and said cursor color based on a predetermined blending ratio to provide color display data.

16. The circuit of claim 9, wherein each pixel circuit comprises:

a direct color circuit to provide direct color;

a look-up table to provide color data; and a blending circuit to blend said direct color and said color data based on a predetermined blending ratio to provide color display data.

17. A color display system comprising:

a memory device to contain display data; and a display control circuit to generate display control data including:

a first circuit to receive display data of a multi-pixel section of a display frame, said multi-pixel section including at least two pixels, a cursor processing circuit to receive cursor data of a cursor in single pixel increments, said cursor processing circuit to determine if a portion of said cursor is located within a set of pixels in said multi-pixel section, and a color processing circuit coupled to said first circuit and said cursor processing circuit, said color processing circuit includes a plurality of pixel circuits corresponding to the number of pixels in said multi-pixel section, one or more pixel circuits to simultaneously process (i) said cursor data and said display data for display on said display frame for each corresponding pixel, if any, in said multi-pixel section that intersects said cursor and (ii) said display data for display on said display frame for a remainder of pixels, if any, in said multi-pixel section that do not intersect said cursor.

18. The circuit as set forth in claim 17, further comprising:

circuitry to determine whether a pixel is comprised of 8, 16, or 32 bits of said display data and to determine said display data into single pixel sections.

19. The circuit as set forth in claim 17, further comprising:

circuitry to determine if a sub-portion of said portion of said cursor is enabled.

20. The circuit as set forth in claim 17, wherein said cursor processing circuit comprises:

an X location register and a Y location register to respectively track an X location and a Y location of said cursor in single pixel increments;

a horizontal counter and a vertical counter respectively to track a horizontal location and a vertical location of said multi-pixel section;

a logic circuit to compare said X location of said cursor with said horizontal location of said multi-pixel section and said Y location of said cursor with said vertical location of said multi-pixel section;

an offset register to calculate an offset using a remainder generated by said logic circuit;

a multiplexer to select a cursor enable data based on said offset; and a latch circuit to apply said cursor enable data to said plurality of pixel circuits.

* * * * *